US005379535A

United States Patent [19]

Bowes, Jr.

[11] Patent Number: 5,379,535

[45] Date of Patent: Jan. 10, 1995

[54] REPLACEABLE EXCAVATING TOOTH ASSEMBLY

[75] Inventor: Stephen M. Bowes, Jr., Jacksonville, Fla.

[73] Assignee: Mobile Pulley & Machine Works, Inc., Mobile, Ala.

[21] Appl. No.: 107,530

[22] Filed: Aug. 17, 1993

Related U.S. Application Data

[63] Continuation-in-part of Ser. No. 982,898, Nov. 30, 1992, abandoned.

[51] Int. Cl.[6] ..... E02F 9/28

[52] U.S. Cl. ..... 37/452; 37/458

[58] Field of Search ..... 37/446, 450, 452–456, 37/458, 326–331

[56] References Cited

U.S. PATENT DOCUMENTS 4,319,415 3/1982 Mayerbock et al. .
4,335,532 6/1982 Hahn et al. .
4,761,900 8/1988 Emrich .
4,965,945 10/1990 Emrich .
5,074,062 12/1991 Hahn et al. .
5,152,088 10/1992 Hahn .
5,177,886 1/1993 Klett .

*Primary Examiner*—Randolph A. Reese
*Assistant Examiner*—Spencer Warnick
*Attorney, Agent, or Firm*—Arthur G. Yeager

[57] ABSTRACT

An assembly of an inner conical adapter nose and an outer tooth having a coaxial conical inner recess, the tooth having spaced helical ears which mesh with spaced helical grooves in the base of the adapter, and at least one key adapted to be inserted into a keyway passing through the adapter base and one tooth ear in a direction generally perpendicular to the coaxis and tangential to the recess. The recess is conical with a mating conical adapter head and the tooth ears are arranged in a square and mate with grooves on the adapter base arranged in a square, and the lands between the grooves of the base substantially fill the spaces between the tooth ears.

20 Claims, 3 Drawing Sheets

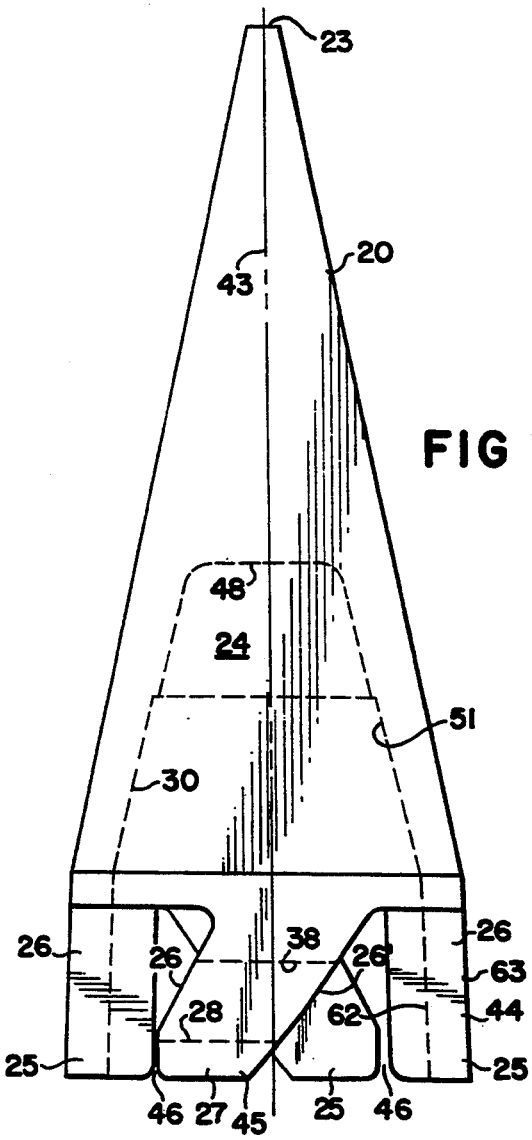
FIG 4
FIG 5
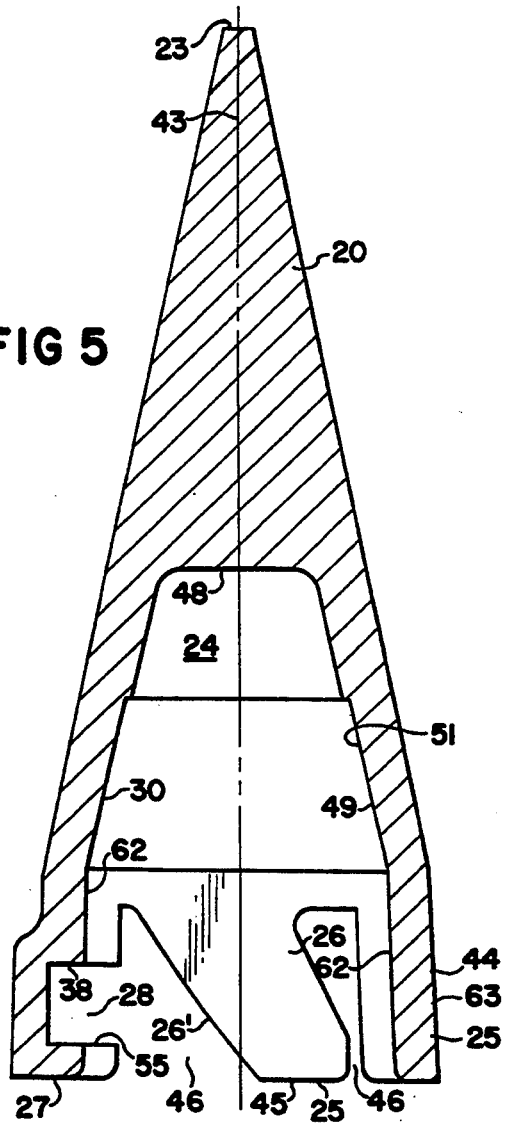
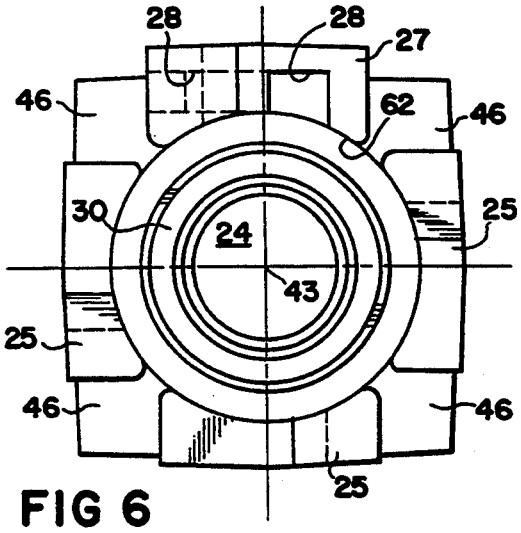
FIG 6
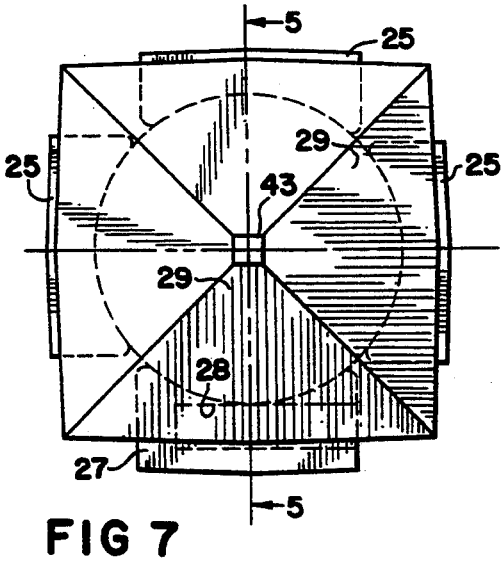
FIG 7

REPLACEABLE EXCAVATING TOOTH ASSEMBLY

RELATED APPLICATION

This application is a continuation-in-part of U.S. application Ser. No. 07/982,898, filed Nov. 30, 1992, now abandoned.

BACKGROUND OF THE INVENTION

Dredging machinery includes an elongated crane with a rotating head with teeth for cutting through mud, sand, rocks, etc., at the bottom of a waterway. The teeth, after some usage, may break or become worn and must be replaced. It has long been a practice to make the teeth in two parts, the inner part being a tooth adapter attached to the dredging head and the outer part being a tooth cap that can be replaced quickly when it wears out or is broken. Tooth assemblies of this general type are described in U.S. Pat. Nos. 3,708,895 and 4,335,532.

The advances in this art have usually been made in the design of the adapter and the tooth, and the manner in which the two are joined together in a working relationship. In U.S. Pat. No. 3,708,895 the tooth and the adapter are joined and separated by a simple linear axial movement and then retained in place by a key perpendicular to and passing through the axis. In U.S. Pat. No. 4,335,532 the tooth and the adapter are joined together by a helical twisting movement and held in place by a horseshoe key. Neither of these systems has proved to be entirely satisfactory and so a new assembly has been developed.

It is an object of this invention to provide a novel excavating tooth assembly. It is another object of this invention to provide a novel excavating tooth assembly that is easier to assemble, disassemble and maintain and at the same time is more secure in its locking system. Still other objects will appear in the more detailed description which follows.

BRIEF SUMMARY OF THE INVENTION

This invention relates to an excavating tooth assembly including an adapter member for attachment to a cutter head, a replaceable tooth member adapted to be removably attached to the adapter member by a male/-female coupling having a common longitudinal axis, and a locking means for locking the tooth member to the adapter member in a nonrotational connection. The adapter member is formed by a solid body having a conical head portion and a base portion with a perimetric surface containing a plurality of spaced generally and longitudinal alternating helical grooves and helical lands. The tooth member includes a generally hollow conical shape with a mid-portion having an inner socket to receive the nose portion of the adapter member, and a base portion being a skirt with a plurality of generally longitudinal and spaced helical ears which fit slidingly into corresponding grooves of the adapter member base portion. The base portions of the adapter member and the tooth member include a keyway extending linearly through both of the tooth and adapter base portions generally perpendicular to and spaced away from the axis. The locking means is defined by a key member adapted to fit closely within and extend through the keyway in both of the base portions of tooth and the adapter members.

In specific and preferred embodiments the adapter member has four spaced grooves and four spaced lands to mate with four spaced ears on the tooth member; the key member and its keyways are located tangentially to the adapter member and the tooth member effectively prevents any relative rotational movement between the adapter member and the tooth member, and the helical connection between the base and tooth members is external of the conical head portion of the adapter member and external to the socket of the tooth member. The key and keyway have offset portions which interlock in full assembly of the tooth and adapter, with a rearward force applied to the tooth ear having the keyway therein by a compression means associated with the key.

BRIEF DESCRIPTION OF THE DRAWINGS

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIG. 4 is a front elevational view of the tooth member in the assembly of this invention;

FIG. 5 is a cross-sectional view taken at 5—5 of FIG. 7;

FIG. 6 is a bottom plan view of the tooth member of FIG. 4;

FIG. 7 is a top plan view of the tooth member of FIG. 4;

DETAILED DESCRIPTION OF THE INVENTION

The features of this invention are best understood by reference to the attached drawings.

Figure 1:
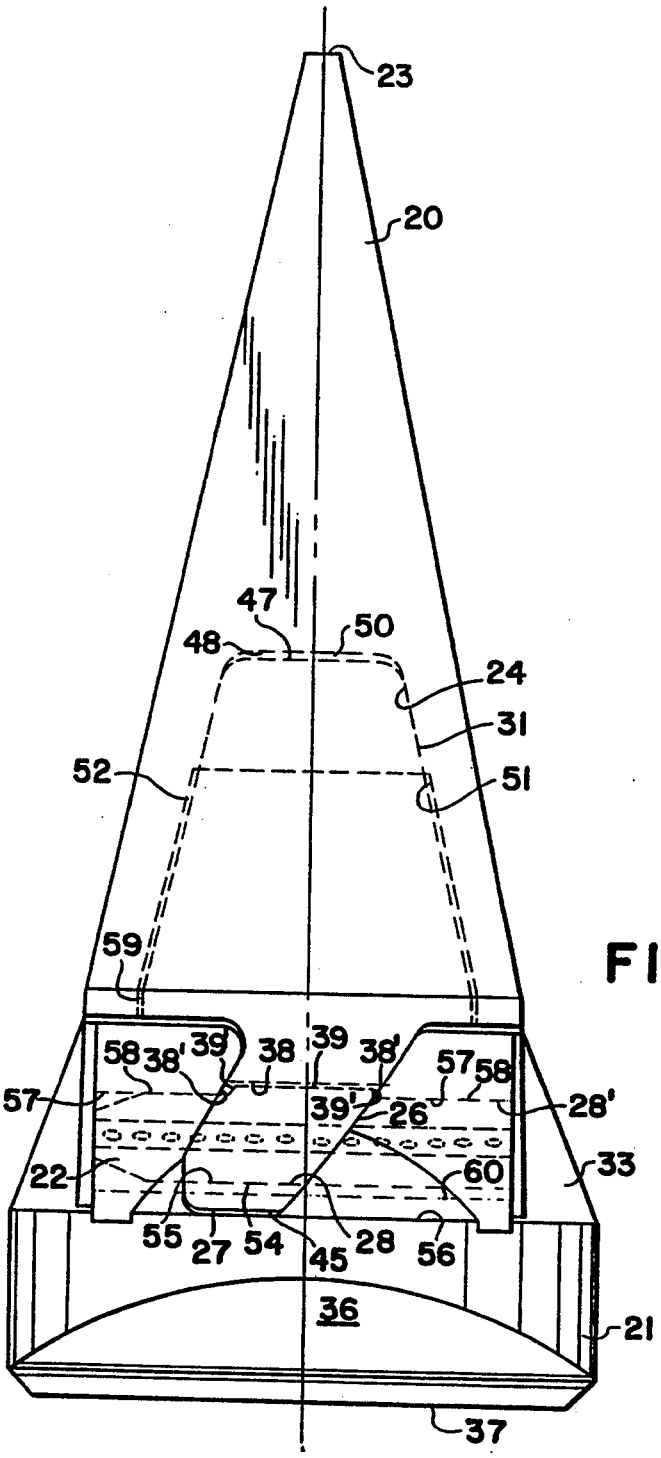
FIG. 1 is a front elevational view of the excavating tooth assembly of this invention.
Figure 2:
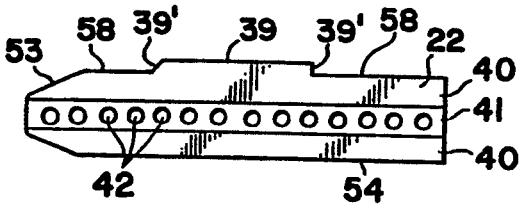
FIG. 2 is a side elevational view of the key in the assembly of this invention.
Figure 3:
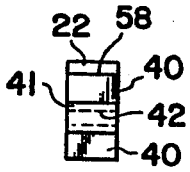
FIG. 3 is an end elevational view of the key of FIG. 2.
Figure 9:
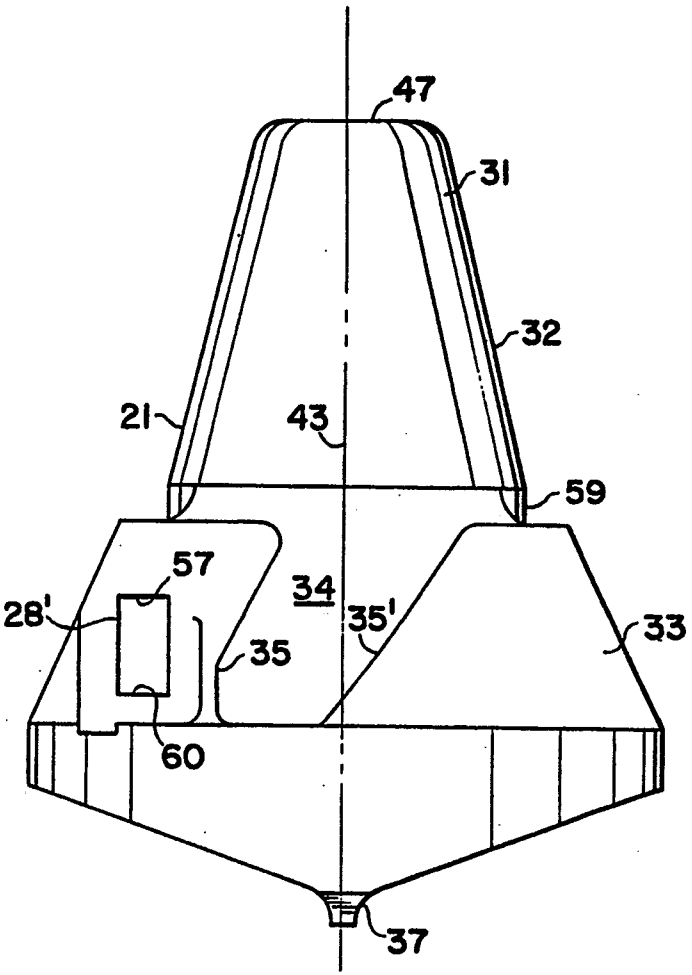
FIG. 9 is a side elevational view of the adapter member of FIG. 8.
Figure 8:
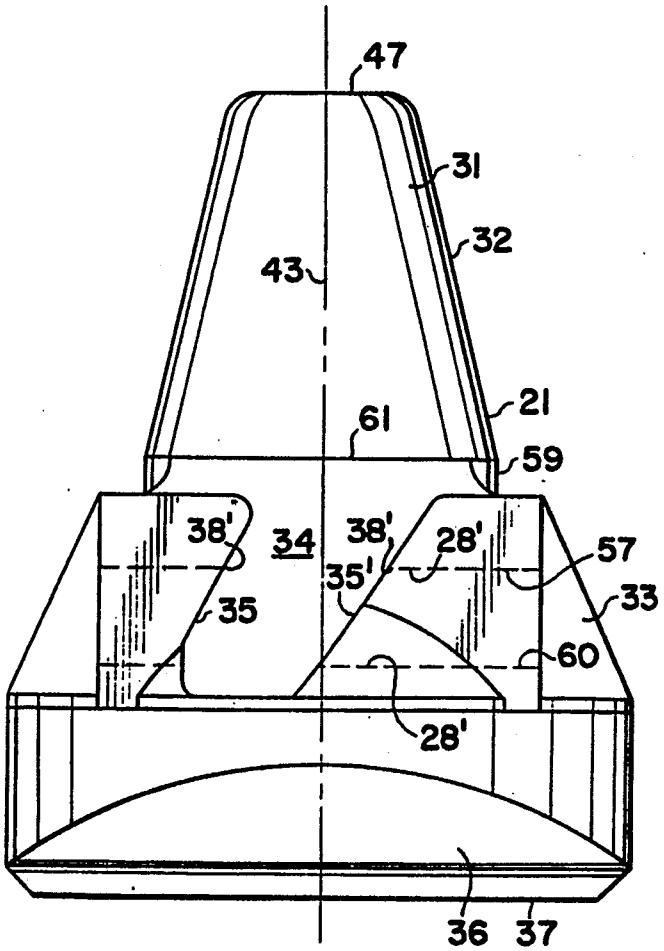
FIG. 8 is a front elevational view of the adapter member of the assembly of this invention.

The complete assembly of FIG. 1 results from the coupling of the tooth of FIGS. 4–7 to the adapter of FIGS. 8–9 and the locking of that coupling by the key of FIGS. 2–3.

The tooth is shown in FIGS. 1 and 4–7 to be a hollow pyramidal cap having an internal frustoconical recess 24 which opens cylindrically at the bottom 45 of tooth 20 and recess 24 is shaped to receive the nose 31 of adapter 21. The lower portion of tooth 20 comprises a skirt 44 of four radially spaced tooth ears 25. Between adjacent tooth ears 25 are slots 46. The walls 26 and 26' of tooth ears 25, 27 are arcuate portions of a helix. The leading helix angle of ears 25, 27, i.e., side wall 26, has a helix angle of about 60°, or 30° relative to the tooth centerline or longitudinal axis 43. The following helix angle of ears 25, 27, i.e., side wall 26', has a helix angle of about 48°, or 42° relative to the longitudinal axis 43. Side wall 26 being the leading helix, must have a greater helix angle than the following side wall 26', since walls 26 and 26' are not radial surfaces but have elements that are parallel to each other and are spaced from the longitudinal axis 43 the elemental width of the ears 25, 27. Since the interior surface 62 of tooth ears 25, 27 is cylindrical about the longitudinal axis 43 and the outer surface 63 is a portion of a square or rectangle, the helix side wall 26' of ears 25, 27 must be of such magnitude that sufficient radial clearance is maintained to allow rotational installation and removal of tooth ears 25, 27 in slots or grooves 34 of adaptor 21. The value of helix angle 26' is determined from the initial helix angle of side wall 26 and the angular displacement required for the disengagement of ears 25, 27 from grooves 34 of adaptor 21. The helix angle or leading wall 26 is preferably a portion of a 60° helix and that of the following wall 26' about 48° but these values can vary based on the angular displacement. Other helix angles are operable, that is, from about 45° to 80° with correspondingly lower values for the following wall 26' of ears 25, 27. Smaller or larger helix angles for wall 26 of ears 25, 27 are impractical in the context of this invention.

The tooth 20 has an internal conical recess 24 which permits it to be symmetrical about the longitudinal axis 43. At least one tooth ear 27 is larger than the other tooth ears 25 in order to accommodate a keyway 28 which is perpendicular to axis 43 and spaced outwardly from axis 43 so as to be tangential to cylindrical surface 59 of adaptor 33 which intersects conical nose 32 along line 61. Tooth 20 has a tip 23 shown here to be a small square, simulating a point. Alternatively, tip 23 may be a chisel edge or any other shape that might be useful in dredging.

In FIGS. 8–9 there is shown the adaptor 21 which is permanently affixed to the dredging head by welding or other fastening technique. Adapters of one or two leg construction may be fitted over a blade or bucket construction as known in the art. Tooth 20 may then be readily attached to the adapter 21 whenever tooth 20 becomes worn or broken and must be replaced. Adapter 21 has a broad solid body 33 and a head or nose portion 31. Body 33 has a wedge-shaped base 36 which tapers down to a keel 37. This arrangement provides a suitable shape for positioning the axis 43 of adapter 21 in any direction and welding adapter 21 to a rigid position as desired. The nose portion 31 of adapter 21 is a frustoconical shape adapted to fit with close tolerances into recess 24 of tooth 20, as described above. There are many ways and places to provide for these close tolerances. The preferred design is to provide a small space between the top surface 47 of adapter 21 and the top surface 48 of recess 24. This space is shown as 50 in FIG. 1. Another small conical space 52 is provided between the offset portion 51 of recess 24 and the outside surface 32 of adapter 2.1. Also, the bottom surface 45 of tooth 20, i.e., including the ears 25, 27 is spaced away from any engagement with its facing walls 56 on adapter 21 by approximately the same amount as space 50 at the nose of cone surface 47.

The body portion 33 of adapter 21 has a conical outside surface containing four lands, four slots or grooves 34 that match the four tooth ears 25, 27 so as to receive ears 25, 27 helically and slidingly into grooves 34. Elementally parallel extending walls 35 and 35' forming each adaptor groove 34 are shaped with the same respective helical arcs or curves as the side walls 26 and 26' of ears 25, 27 and are determined in the same manner with wall 35 of slot 34 being essentially the same as side wall 26 of ears 25, 27 and wall 35' being essentially the same as side wall 26' of ears 25, 27. The helix angle of wall 35 of slot 34 is preferably a portion of a 60° helix and that of wall 35' is determined in the same manner as side wall 26' of ears 25, 27 and is thus about 48°. It will therefore become apparent that to couple a tooth 20 to an adaptor 21 it is necessary to slide tooth 21 axially over adaptor nose 31 such that all ears 25 and 27 enter into the respective adaptor grooves 34 generally simultaneously. Tooth 20 is then twisted to the right for about 15° to 25° to advance the forward ends of tooth ears 25, 27 to the bottoms of grooves 34 so as to completely seat tooth 20 onto adapter 21. It is, of course, optional to make the helix angles of tooth ears 25, 27 and slots 34 have a left-hand twist instead of the right-hand twist shown in the drawings. Generally, the axial length of tooth ears 25, 27 and tooth slots 46 is the same and is 10%–30% of the total overall length of tooth 20. Correspondingly, adapter grooves 34 are the same length as tooth ears 25 but not the same percentage of axial length of adapter 21, i.e., being only about 20%–30%.

To cooperate with the keyway 28 mentioned above with respect to tooth 20, there is a keyway 28' in the adapter 21. When tooth 20 is completely assembled onto adapter 21 there is a single through passageway formed by keyway 28 of the tooth 20 and keyway 28' of the adapter 21. Preferably, keyway 28/28' is rectangular in cross-section, and other shapes are optional, e.g., circular, triangular, etc. If desired, one may provide the tooth 20 with another keyway in a duplicate to ear 27 (rather than the ear 25) which is diametrically opposite to the present ear 27. Accordingly, adapter 21 would necessarily include another keyway diametrically opposite to keyway 28' to accommodate another key, like key 22, as would be apparent to those skilled in the art.

In FIGS. 2 and 3 there is illustrated the preferred pin or key 22 for use in keyway 28/28'. Key 22 is an elongated member having a rectangular cross-section and the driven end of the key 22 may be tapered to permit easier driving on the opposite or driving end of the key 22. Key 22 is preferably made as a three-layer laminate of two outside layers 40 of steel and a central layer 41 of resilient material, such as rubber or neoprene, through which a plurality of spaced holes are provided. Generally medially of key 22, an enlargement or offset portion 39 is provided which interlocks with the offset of keyway 28 in ear 27 from the keyway 28' in adapter body 33.

The assembly and locking procedure of tooth 20 to adapter 21 employing key 22 is specifically described. When tooth 20 is assembled onto adapter body 33 by axial and rotative movement of the tooth 20 so that ear 27 is located in the position shown in FIG. 1, the keyway 28 in tooth ear 27 is offset with respect to the keyway 28' in adapter body 33, so that the rearward surface 55 of passageway 28 is forward of the rearward surface 60 of the keyway 28' in adapter body 33. Accordingly, the forward surface 38 of keyway 28 in ear 27 is also forward of the corresponding surface 57 of the keyway 28' in adapter body 33. As the key 22 is driven into keyway 28', from the right as seen in FIG. 1, the key 22 is compressed by compression of the central layer 41, so when the key 22 is fully seated, surface 54 of key 22 engages surface 55 of the keyway 28 in ear 27 and the opposite or forward surfaces 58 of key 22 engage surfaces 57 in keyway 28' of adapter 33. Thus, a rearward force is produced on tooth 20 tending to more fully seat conical surface 24 of tooth 20 on to the conical surface 31 of adapter 21. As seen, the offset of keyway 28 in ear 27 provides for a greater clearance than the height of enlargement or offset portion 39 on pin 22 and permits offset portion 39 to snap into the offset portion 38 so that shoulders 39' on offset portion 39 may engage or be stopped by the edges or shoulders 38' of surfaces 57 of keyway 28' in adapter body 33 thus preventing the key 22 from working out in use of the tooth 20 on the cutter head to which adapter 21 is attached and preventing relative rotation of tooth 20 on adapter 21. Furthermore, key surface 54 does not engage keyway surface 60 of passageway 28' in adapter body 33. Even when the key 22 is fully inserted in the position shown in FIG. 1, the resilient material 41 remains compressed so that the key 22 will continue to be seated until driven out by a chisel and hammer, or the like.

The helical connection between the tooth 20 and the adapter 21 is external of the adapter conical nose or head 31 and external to the recess 24 of the tooth 20 which is fitted thereon, thereby distributing the loads more evenly and to greater masses of material via the adapter body 33 into the cutter head or the like. In U.S. Pat. No. 4,335,532 a small and sufficient twist of the tooth completely unlocks the tooth from the adapter due to the fact that the connection is formed by corners of a truncated polygon on the adapter nose and in the corresponding recess of the tooth, whereas the instant tooth requires rotation of the tooth 20 with respect to adapter 21 of about 15° to 25° before the end of the ears 25 and 27 are clear of the lands of the adaptor body 33. Also, the ears 25 and 27 have walls 26 and 26' which contact oppositely facing walls 35 and 35' of adaptor body 33 to retain the ears 25, 27 in grooves 34 while the key 22 locks the tooth 20 on adaptor 21. These walls 26 and 26' and 35 and 35' are shown as being perpendicular to the outside surfaces of skirt 44 and tooth ears 25 and 27, but they may be radially directed or perhaps even dovetail without departing from the invention. It should be noted that if the lands and walls were radially directed, the helix angles of each of the walls 26' and 35' would be the same as side wall 26 of ears 25, 27 and the width of the ears 25, 27 would be uniform in the areas of the two helixes.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention.

What is claimed as new and what it is desired to be secured by Letters Patent of the United States is:

1. An excavating tooth assembly comprising an adaptor member for attachment to a cutter head, a replaceable tooth member adapted to be removably attached to said adaptor member by a male/female coupling having a common longitudinal axis, and a locking means for locking said tooth member to said adaptor member in a nonrotational connection; said adaptor member being a solid body having a conical nose portion and a base portion, said base portion having a parametric surface containing a plurality of generally longitudinal alternating helical grooves and externally exposed helical lands; said tooth member having a generally hollow conical shape with a mid portion including an inner socket to receive said nose portion of said adaptor member, and a base portion formed as a skirt having a plurality of generally longitudinally spaced, externally exposed, helical ears which fit slidingly into corresponding said grooves of said adaptor member base portion with both said helical lands and ears forming an external surface of said assembly, said base portions of said adaptor and tooth members including at least one keyway extending linearly through both said base portions generally perpendicular to and spaced away from said axis; said locking means including at least one key member, having opposite sides and being adapted to fit closely within and extend through said at least one keyway and engaging both said base portions respectively on said opposite sides of said key member.

2. The tooth assembly of claim 1 wherein said plurality of alternating helical grooves and lands is defined by four spaced grooves and four spaced lands.

3. The tooth assembly of claim 1 wherein said base portion of said adapter member includes a substantially cylindrical surface upon which said tooth is rotated in assembly and disassembly.

4. The tooth assembly of claim 3 wherein said keyway has a central longitudinal axis positioned substantially tangential to said cylindrical surface of said adapter member.

5. The tooth assembly of claim 1 wherein said keyway has a generally rectangular cross section.

6. The tooth assembly of claim 1 wherein said key member is an elongated pin generally rectangular in cross section and including three elongated laminated layers, the central layer being a compressible and resilient material and the other two layers being steel.

7. The tooth assembly of claim 1 wherein said helical grooves on said base portion of said adaptor member and said ears on said base portion of said tooth member are positioned at an angle of about 10–45 degrees from said axis.

8. The tooth assembly of claim 1 wherein each of said ears has a pair of spaced longitudinally extending oppositely facing walls, each of said adapter grooves being formed by a pair of spaced oppositely facing walls, respective said pair of walls of said ears being disposed juxtaposed with respective pair of walls of said adapter when said tooth and said adapter are connected by said locking means.

9. The tooth assembly of claim 1 wherein said keyway and said key member each have a corresponding offset step portion generally medially of the overall length of said keyway and said key member, said keyway offset portion receiving said key offset portion and maintaining said key in said keyway from inadvertent dislodgement.

10. An excavating tooth assembly comprising an adaptor, an elongated tooth, and a locking pin; said adaptor being a prong-shaped member having a frustoconical forward nose and a rearward base portion positioned along a central longitudinal axis, said base portion having a plurality of equally spaced lands with helical edges and with a helical groove formed by inwardly directed oppositely facing and spaced walls between each pair of spaced adjacent edges, said edges being positioned at an angle of about 10–45 degrees from said axis, said tooth being a prong-shaped member having a point portion, a mid-portion and a rearward portion, said point portion being a solid structure tapering in generally pyramidal outer shape from a point to said mid-portion, said mid-portion having an interior recess to fit over said forward nose of said adaptor in a male/female relationship with said mid-portion of said tooth covering said nose of said adaptor, said rearward portion of said tooth overlying said base portion of said adaptor, said rearward portion having a plurality of spaced helical ears depending from said mid-portion and having internal and external surfaces said helical ears having spaced oppositely facing walls to snugly fit in respective said groove of said base portion between said spaced walls of said groove, a passageway extending through said adaptor and one said tooth ear and in a direction laterally offset and remote from said axis, said locking pin being located within said passageway for applying a rearward retaining force on said one tooth ear and preventing any relative rotation about said axis by said tooth with respect to said adaptor, said lands of said base portion having external surfaces forming with said external surfaces of said ears an external surface of said assembly, said internal surfaces of said ears forming a cylindrical surface for relative rotation of said tooth on said adaptor.

11. The tooth assembly of claim 10 wherein each of said helical ears has an axial length of about 10%-30% of the overall length of said tooth.

12. The tooth assembly of claim 10 wherein said passageway has an offset portion in one said tooth ear generally centrally thereof which is forwardly disposed with respect to said passageway through said adapter, and said locking pin has an offset enlargement portion disposed within said offset portion in said one tooth ear to prevent inadvertent dislodgement of said pin from said passageway.

13. The tooth assembly of claim 12 wherein said locking pin is compressible in the same direction as said longitudinal axis of said tooth.

14. The tooth assembly of claim 13 wherein said locking pin is a laminate of three lengthwise layers, the central one being a compressible resilient material, and the outer ones being a hard metal, said central layer being compressed to forcefully snap said offset enlargement portion of said pin into said offset portion of said one tooth ear.

15. The tooth assembly of claim 12 wherein a forward edge of said offset portion of said passageway in one said tooth ear is spaced forwardly from said offset portion of said locking pin, a rearward edge of said locking pin engages a rearward wall of said passageway in said tooth, said locking pin being compressible to apply a compressible rearward force on said tooth tending to fully seat said tooth on said adapter.

16. The tooth assembly of claim 15 wherein said offset portion of said locking pin includes a pair of spaced shoulders which are stopped by a pair of spaced shoulders of said offset portion of said passageway of said adapter to prevent said locking pin from working out of locking engagement between said tooth and adapter during use of the tooth assembly.

17. An excavating tooth member adapted to be removably attached to an adaptor member connected to a cutter head comprising an elongated unitary member having a ground engaging forward portion and a base portion for rotative removable attachment to an adaptor, said base portion having an elongated recess with a longitudinal axis, said base portion having a plurality of spaced helical ears with a groove between adjacent said ears communicating throughout with said recess, said helical ears providing sliding coupling engagement correspondingly within spaced helical grooves on an adaptor by partial rotation of said tooth about said longitudinal axis on an adaptor, said helical ears being extended generally along said longitudinal axis and terminating in free ends, said helical ears having an internal surface forming a cylindrical surface for partial rotation of said tooth on an adapter, said recess being located forwardly of said helical ears for receiving a nose portion of an adapter, locking means located offset from said longitudinal axis and in one of said helical ears spaced from said free end to inhibit reverse rotation of said tooth member on an adapter.

18. The tooth member of claim 17 wherein said locking means includes a passageway laterally through one said ear.

19. The tooth member of claim 18 wherein said elongated recess is conical and wherein said passageway through said ear is defined by a groove opening inwardly against a cylindrical surface of an adapter to which said tooth member is attachable.

20. The tooth member of claim 17 wherein said plurality of ears includes four equally spaced ears.

* * * * *